United States Patent [19]

Leavitt

[11] 4,166,416

[45] Sep. 4, 1979

[54] OBTURATING SPLIT DISC

[75] Inventor: Leland F. Leavitt, Ogden, Utah

[73] Assignee: The United States of America as represented by the Secretary of the Air Force, Washington, D.C.

[21] Appl. No.: 900,949

[22] Filed: Apr. 28, 1978

[51] Int. Cl.[2] ..... F42B 25/20

[52] U.S. Cl. ..... 102/2

[58] Field of Search ..... 102/2–4, 102/223, 225, 263, 1 R

[56] References Cited

U.S. PATENT DOCUMENTS 2,364,197 12/1944 Dee ..... 102/2

*Primary Examiner*—Charles T. Jordan

*Attorney, Agent, or Firm*—Joseph E. Rusz; Arsen Tashjian

[57] ABSTRACT

A structural improvement to, and a method of improving, an air-dropped spin-actuated bomb of the anti-personnel type. The structural improvement comprises a split flexible polyethylene obturating disc which replaces the prior art rigid metal obturating disc used on these bombs. The improved disc is releasably connected to the bomb, whereas the prior art disc is fixedly attached to the bomb. The method comprises the step of disposing and releasably connecting the split flexible polyethylene obturating disc to the bomb at a location between the forward body section of the bomb and the aft fin section thereof. The result of the use of the structural improvement, and of the improvement method, is that the arming of the bomb is delayed, so that the bomb, which could only be safely air-dropped from a low speed aircraft, now can also be air-dropped from a high speed, or a very high speed, aircraft.

4 Claims, 3 Drawing Figures

OBTURATING SPLIT DISC

STATEMENT OF GOVERNMENT INTEREST

The invention described herein may be manufactured and used by or for the Government for governmental purposes without the payment of any royalty thereon.

BACKGROUND OF THE INVENTION

This invention relates to an improvement to an air-dropped bomb, whereby the rate of spin of the bomb in the air is reduced, and to a method of attaining that objective (i.e., rate of spin reduction).

One of the many types of bombs is an air-droppable bomb of the anti-personnel type having a forward body section, and an aft fin section with a diameter. This type of bomb spins after it has been air-dropped; is armed internally by the spinning of the bomb; and, the completion of the arming depends upon the rate of spin of the bomb.

The bomb is very effectively used with low speed aircraft. However, with the advent and use of high speed aircraft, the use of this type of bomb is greatly reduced or, with very high speed aircraft, is entirely eliminated since the spin imparted to the bomb is dependent, among other factors, on the speed of the aircraft from which it is dropped.

It is here to be noted that the present structure of this bomb includes a disc of rigid material, i.e., stainless steel, which is fixedly and permanently attached to, and integrated with, the bomb between the forward body section and the aft fin section. The purpose of the disc is to obturate, or otherwise impede or retard, some of the air flow through the aft fin section to control the rate of spin and the completion of arming of the bomb. However, the metal disc is sized for use with low speed aircraft.

The currently existing problem is that, since the aircraft in the U.S. Government inventory are high speed or very high speed ones, none of these existing bombs can be safely used, because they would prematurely arm and detonate if dropped from these aircraft, thereby not accomplishing the purpose intended (i.e., injuring or killing personnel of a hostile nation). In addition, the use of these bombs, and the resultant premature arming and detonation, may cause extensive damage or destruction to high speed and very high speed aircraft dropping the bombs. Further, after premature detonation, these bombs may cause the undesired and unintended detonation of bombs dropped behind and after the lead bombs.

The obvious solution to this problem would appear to be the removal of the existing metal disc from each bomb, and the replacement of it with a properly sized one. As a practical matter, this is not feasible, because the metal disc can only be replaced by removing the aft fin section; and, in turn, this requires drilling out rivets on the fins, which is so hazardous that the U.S. Government prohibits it.

However, since the metal disc can be clipped (although destroyed thereby), and thereby can be removed from the bomb with safety, I have invented an improved disc which thereafter can be easily, and removably, attached to each of these existing bombs and, thereby, render these now useless bombs to bombs that can be used safely and effectively by high speed and very high speed aircraft.

I have, as a result, significantly advanced the state-of-the-art.

SUMMARY OF THE INVENTION

The principal object of this invention is to provide a structured improvement to, and a method of improving, an air-droppable bomb of the anti-personnel type, whereby such a bomb (which was originally configurated and structured for air-drop only from a low speed aircraft, and cannot be air-dropped safely from a high speed or very high speed aircraft) can, by the use of my structrual improvement and/or the practice of my improvement method, be air-dropped from high speed and very high speed aircraft.

This principal object, as well as other related objects, of this invention will become readily apparent after a consideration of the description of my invention's structural improvement, and improved method, together with reference to the Figures of the drawings, in which the same reference numeral refers to the same component, element and the like.

DESCRIPTION OF THE PREFERRED EMBODIMENT

Figure 1:
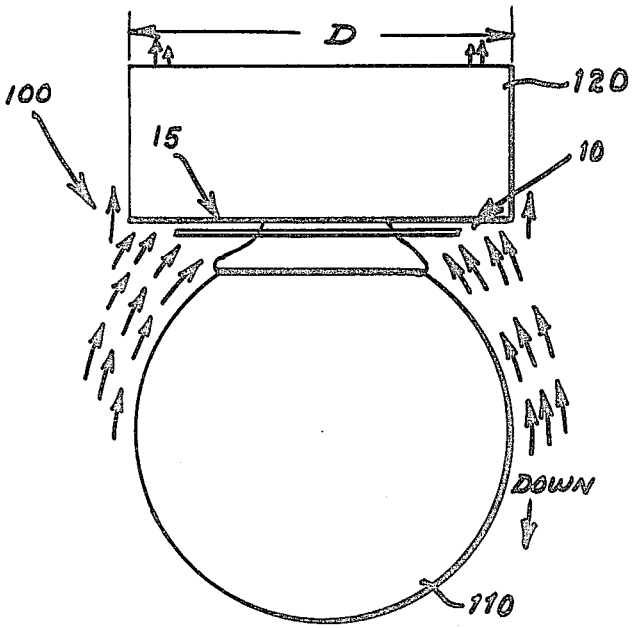
FIG. 1 is a side elevation view, in simplified schematic form, of an air-droppable bomb of the anti-personnel type, in a vertical position in its working environment after having been air-dropped, that structurally incorporates a preferred embodiment of my inventive improvement.
Figure 2:
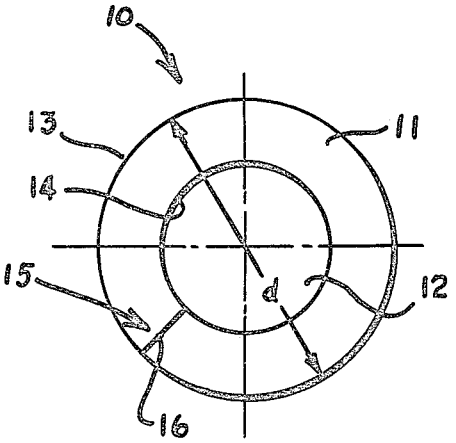
FIG. 2 is a top view of the preferred embodiment of my inventive improvement, in simplified pictorial form.
Figure 3:
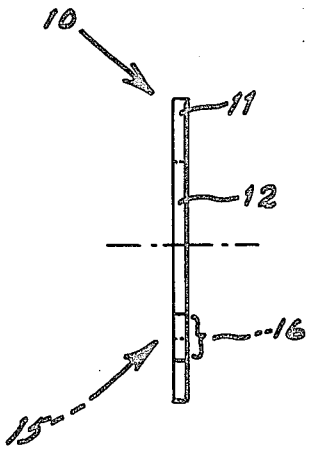
FIG. 3 is a side elevation view, also in simplified pictorial form, of the preferred embodiment of my inventive improvement.

With reference to FIGS. 1–3, inclusive, therein is shown in three views and in simplified schematic and pictorial forms, the preferred embodiment (generally designated 10) of my inventive structural improvement.

As shown in FIG. 1, the preferred embodiment of my structural improvement 10 is for use with an air-dropped bomb of the anti-personnel type, such as 100, which has a forward body section 110, and an aft fin section 120 with a diameter "D".

In the most basic and generic structural form, my structural improvement 10 comprises: a disc 11 of resilient plastic material, preferably polyethylene, having a centrally located aperture 12 therein and therethrough, and also having a preselected diameter "d" that is smaller (i.e., shorter) than the diameter "D" of the aft fin section 120; and, means (generally designated 15) for releasably connecting the disc 11 to the bomb 100 (prior, of course, to air-dropping of the bomb 100).

As can be seen from FIG. 1, the disc 11 is interposed between the forward body section 110 of the bomb 100 and the aft section 120 thereof; and, the disc 11 is releasably connected by means 15 to the bomb 100 at that location (i.e., intermediate the body section 110 and the fin section 120).

With reference to FIG. 2, one can see that the disc 11 of my structural improvement 10 has a circumference 13 and the disc aperture 12 (which is shown as circular, but need be in that geometric shape) has a perimeter 14. Also shown in FIG. 2 is a representative, and preferred, means 15 for releasably connecting the disc 11 to the bomb 100, FIG. 1. This particular means 15 includes a slit 16 at one location of, on, and at the disc 11, with the slit 16 extending from the aperture perimeter 14 to the disc circumference 13, which results in the splitting of the disc 11 and, because of that, also facilitates (as will be explained later herein) the connection of the disc 11 to, and/or its release from, the bomb 100, FIG. 1.

DESCRIPTION OF THE INVENTIVE METHOD

The crux of my inventive method is that its practice results in the delayed arming of the bomb 100, FIG. 1, which in turn results in the useability of the bomb by high speed, and very high speed, aircraft.

My method of improving (the useability) the bomb 100, heretofore structurally described, comprises one step, to wit: interposing and releasably connecting a polyethylene disc, that has a split (such as 16, FIGS. 2 and 3) at one location and that has a diameter (such as "d", FIG. 2) smaller than the diameter (such as "D", FIG. 1) of the aft fin section (such as 120, FIG. 1) of the bomb, to the bomb at a position intermediate of the forward body section (such as 110, FIG. 1) and of the aft fin section of the bomb.

Thereby, I delay the arming of the bomb and improve the useability of it.

MANNER OF OPERATION OF THE IMPROVEMENT

The manner of operation (or of use) of my improvement, structurally and method-wise, can be ascertained very easily by a person of ordinary skill in the art from the foregoing description, coupled with reference to the Figures of the drawing.

For others, it is sufficient to say in explanation that my improvement: obturates some of the air flow through the aft fin section 120, as shown by the arrows in FIG. 1; delays the arming, and the completion of the arming, of the bomb 100, FIG. 1; and, permits the use of bombs that are not presently safely usable by high speed, and very high speed, aircraft.

It is to be understood of course that, if the the bomb is still equipped with the prior art metal disk, the disc may be easily, quickly, and safely removed from the bomb by clipping it from the bomb. Although this destroys the prior art metal disc, the removal of the disc permits the releasable connection of my disk to the bomb. This is very easily accomplished by spreading the disc 11 apart at the slit 16 and merely slipping the disc 11 onto the bomb.

CONCLUSION

It is abundantly clear from all of the foregoing, and from the Figures of the drawings, that the stated desired principal object, and other related objects, of my inventive improvement have been achieved.

It is to be noted that, although there have described the fundamental and unique features of my inventive improvement, as applied to a preferred structural embodiment and a method, various other embodiments, variations, adaptations, substitutions, additions, omissions, number and sequence of steps of my method, and the like may occur to, and can be made by, those of ordinary skill in the art, without departing from the spirit of my inventive improvement.

What is claimed is:

1. In an air-dropped bomb of the anti-personnel type having a forward body section, and an aft fin section with a diameter, wherein said bomb is air-dropped, it spins and is thereby armed internally, and wherein completion of said arming depends upon the rate of spin of the bomb, the improvement comprising:

a. a disc of resilient plastic material having a centrally located aperture therein, and also having a preselected diameter that is smaller than said diameter of said aft fin section;

b. and, means for releasably connecting said disc to said bomb prior to the air-drop of said bomb;

wherein said disc is interposed between said forward body section and said aft fin section, and is releasably connected by said means to said bomb threat;

whereby said disc obturates some air flow through said aft fin section, and said rate of spin of said air-dropped bomb is decreased; and thereby, the completion of said arming is delayed.

2. The improvement, as set forth in claim 1, wherein said disc has a circumference and said aperture of said disc has a perimeter, and wherein said means for releasably connecting said disc to said bomb, prior to air-dropping said bomb, includes a slit at one location of said disc, wherein said slit extends from said aperture perimeter to said disc circumference, whereby said disc is split and, thereby, connection of said disc to said bomb and release therefrom are facilitated.

3. The improvement, as set forth in claim 2, wherein said resilient plastic material of which said disc is made is polyethylene.

4. The method of improving an air-droppable bomb of the anti-personnel type having a forward body section, and an aft fin section with a diameter, wherein said bomb spins when it is air-dropped, and wherein said spinning internally arms said bomb, and also wherein the completion of said arming depends upon the rate of spin of the bomb, comprising the step of interposing and releasably connecting a polyethylene disc, that has a split at one location and that has a diameter smaller than the diameter of said aft fin section of said bomb, to said bomb intermediate said forward body section and said aft fin section of said bomb, whereby the arming of said bomb is delayed.

* * * * *